US010562199B2

(12) United States Patent
Lettenberger et al.

(10) Patent No.: US 10,562,199 B2
(45) Date of Patent: Feb. 18, 2020

(54) CONNECTING MEMBER

(71) Applicant: The Gillette Company, Boston, MA (US)

(72) Inventors: Neil Lettenberger, Boston, MA (US); David Wayne Morris, Sterling, MA (US)

(73) Assignee: The Gillette Company LLC, Boston, MA (US)

( * ) Notice: Subject to any disclaimer, the term of this patent is extended or adjusted under 35 U.S.C. 154(b) by 379 days.

(21) Appl. No.: 14/591,040

(22) Filed: Jan. 7, 2015

(65) Prior Publication Data

US 2015/0197017 A1 Jul. 16, 2015

Related U.S. Application Data

(60) Provisional application No. 61/927,721, filed on Jan. 15, 2014.

(51) Int. Cl.

| | |
|---|---|
| ***B26B 21/40*** | (2006.01) |
| ***B26B 21/52*** | (2006.01) |
| ***B26B 21/22*** | (2006.01) |

(52) U.S. Cl.

CPC ..... *B26B 21/4012* (2013.01); *B26B 21/225* (2013.01); *B26B 21/521* (2013.01)

(58) Field of Classification Search

CPC .. B21B 21/225; B21B 21/4012; B21B 21/521

See application file for complete search history.

(56) References Cited

U.S. PATENT DOCUMENTS

| | | | | |
|---|---|---|---|---|
| 7,708,283 | B2 * | 5/2010 | Azibert | F16J 15/3488 277/370 |
| 7,877,879 | B2 * | 2/2011 | Nakasuka | B26B 21/44 30/41 |
| 2006/0228179 | A1 * | 10/2006 | Alm | B23B 27/145 407/113 |
| 2009/0038167 | A1 * | 2/2009 | Peyser | B26B 21/225 30/532 |

(Continued)

FOREIGN PATENT DOCUMENTS

| | | |
|---|---|---|
| EP | 2387489 | 11/2011 |

OTHER PUBLICATIONS

BASF Corporation (Snap-Fit Design Manual, 2007, http://web.mit.edu/2.75/resources/random/Snap-Fit%20Design%20Manual.pdf).*

(Continued)

*Primary Examiner* — Kenneth E Peterson
*Assistant Examiner* — Liang Dong
(74) *Attorney, Agent, or Firm* — Joanne N. Pappas; Kevin C. Johnson

(57) ABSTRACT

A novel connecting member of razor is shown to have a plurality of chamfers on at least one finger disposed at an end of an arm. Desirably, both arms have two chamfers on each finger. Each chamfer is disposed having an angle to a top surface of the finger. Though any angles are contemplated in the present invention, the angle of the first chamfer is desirably smaller than the angle of the second chamfer. The bearing length of the finger and the first chamfer angle are together desirably balanced to provide an optimal clearance for the fingers into openings on either end of the back of the housing and improve the pivot operation and control for the user.

12 Claims, 6 Drawing Sheets

FIG. 4b

(56) References Cited

U.S. PATENT DOCUMENTS

| | | | | |
|---|---|---|---|---|
| 2009/0170616 | A1* | 7/2009 | Souda | F16C 3/02<br>464/162 |
| 2010/0043242 | A1 | 2/2010 | Stevens | |
| 2011/0088269 | A1* | 4/2011 | Walker, Jr. | B26B 21/225<br>30/527 |
| 2012/0096718 | A1* | 4/2012 | Howell | B26B 21/225<br>30/77 |

OTHER PUBLICATIONS

PCT International Search Report with Written Opinion in corresponding Int'l appln. PCT/US2015/011143 dated Jun. 16, 2015.

* cited by examiner

CONNECTING MEMBER

FIELD OF THE INVENTION

This invention relates to a connecting member for a razor cartridge, and more particularly to structures on the member.

BACKGROUND OF THE INVENTION

In many current razors, the blade unit or razor cartridge is connected to the handle either by a connecting member indirectly to a handle or a connecting member that is integrated with a handle, and thus, directly to the handle. The connecting member generally has a pair of arms which connect to the blade unit and allow the blade unit in many instances to pivot about an axis relative to the connecting member. Similarly, in many razors without such a stand-alone connecting member, (e.g., a disposable type razor or a system type razor having a handle with an integrated connecting member in an upper portion) a pair of arms are generally also present on the upper portion of the handle for connection of the handle to the blade unit and in many instances, to allow the blade unit to pivot about an axis relative to the handle.

The pivoting function of the razor may occasionally not perform optimally. Generally, the cause may be attributed to the pivot rotation becoming jammed or otherwise immovable or compromised, or other interference of the connecting member with the housing of the razor cartridge. This may occur because of build-up of debris over time (e.g., cut hairs, dried or excess shave preparation) or too many physical drops (e.g., head down) during the course of use of the razor.

An improvement in the structure of the arms is needed to provide better control and functionality of the pivot mechanism, while still providing ease of manufacture and in turn offering the consumer a more pleasant operational experience.

SUMMARY OF THE INVENTION

In accordance with the invention, a razor connecting member includes at least one finger having a plurality of chamfers. The connecting member is separable from a razor handle or integrated with a razor handle.

in another aspect of the invention, a first chamfer angle is smaller than a second chamfer angle. In further aspects of the invention, a first chamfer has an angle ranging from about 15 to about 45 degrees, a second chamfer has an angle ranging from about 45 to about 80 degrees, and a bearing length of said at least one finger ranges from about 1.50 mm to about 2.50 mm. In yet a further aspect, a first chamfer has an angle of about 25 degrees and said finger has a bearing length of about 1.94 mm.

In yet another aspect of the invention, a clearance of said finger to a cartridge housing is about 0.134 mm. Still further, at least one finger attaches to a cartridge housing wherein the attachment comprises an opening at a back of said housing into which a finger is disposed.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

The novel connecting member structure of the present invention having a plurality of chamfers in at least one of the fingers of the connecting member arms improves control and functionality of the pivot mechanism while still providing ease of manufacture and in turn offering the consumer with a much more pleasant operational experience.

The present invention focuses on the novel structure of the arm fingers and does not generally describe how to manufacture the novel connecting structure or assemble it onto the blade unit.

The term "chamfer" as used herein signifies a cut in a material, which cut is generally at an angle less than 90 degrees to adjacent principle faces. The term "chamfer" may oftentimes be referred to as a bevel and as such, these terms may be deemed equivalent and/or interchangeable.

The term "connecting member" as used herein signifies a structure which serves to ultimately connect or attach a blade unit to a handle. Such a member may have similar structure but be of different type. For instance, the connecting member of the present invention may be a stand-alone component as in many razors which component is joined both to a blade unit via arms and fingers and also, via other connecting structures, to a handle. The connecting member of the present invention may also be formed as one piece with the handle, either integrally formed with a handle, or joined to an upper portion of a handle, where the handle is attached to a blade unit via the connecting member. The razors of the present invention may be a disposable type, which are generally disposed of after a few shaves, or a system type, where the blade unit is disposed of (e.g., the handle is kept), and new replacement blade units can be attached.

The term "angled" as used herein may signify a surface that has an angle or angles, is disposed at a slant or bent at an angle, which may or may not be linear.

Figure 1:
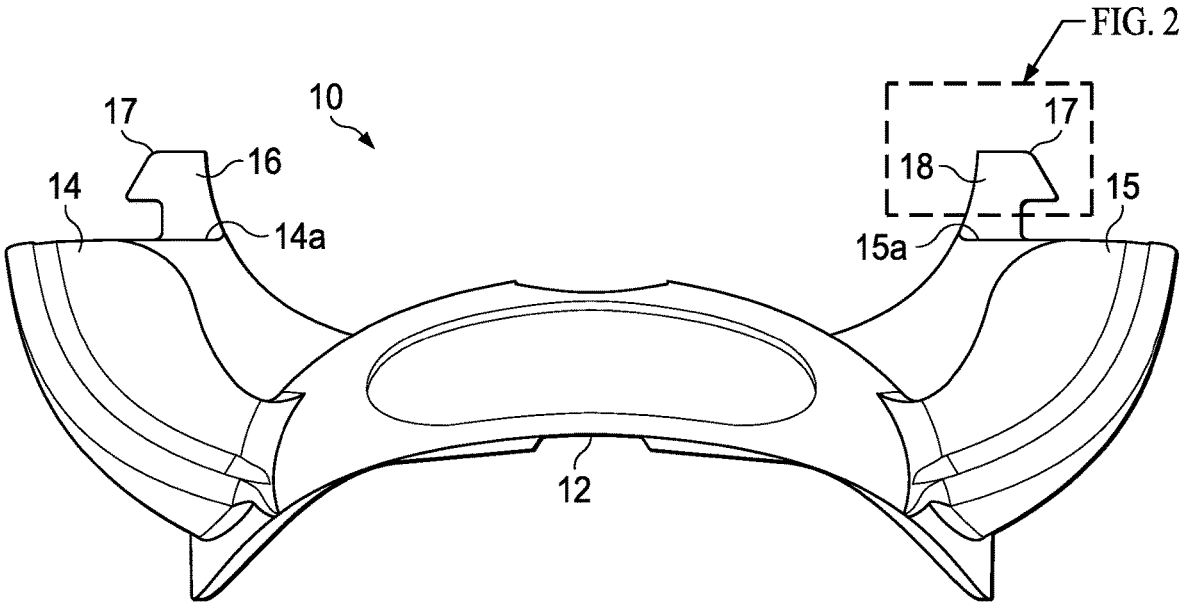
FIG. 1 is a diagrammatical view of a prior art connecting member.
Figure 2:
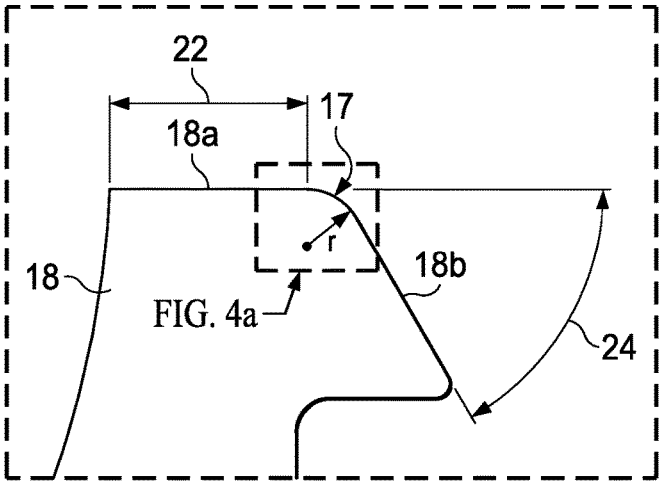
FIG. 2 is a close up view of one of finger areas of the connecting member of FIG. 1.

Referring to FIG. 1, a prior art connecting member 10 is shown having a body 12, a pair of arms 14 and 15 extending outwardly from the body 12. Extending from ends 14*a* and 15*a* of the arms 14 and 15, respectively, are fingers 16 and 18. As can be seen in FIG. 2, finger 18 has a rounded curve profile 17. Though not shown in FIG. 2, a matching (flipped horizontal) rounded curve profile 17 is found on finger 16 also.

Finger 18 is shown as having angle 24 which represents the angle from the angled side surface 18*b* to the top 18*a* surface of finger 18, the latter which is desirably a substantially horizontal, straight line, as shown. Angle 24 of the prior art is generally about 65 degrees while the radius of curvature R at curved profile 17 is about 0.42 though many variations exist in the prior art.

A lower bearing length 22 of each finger 16, 18 of the prior art is about 1.90 to about 2.10 mm, or about 2.00 mm. This length is generally important to minimize stress on the housing of a razor cartridge.

Figure 3:
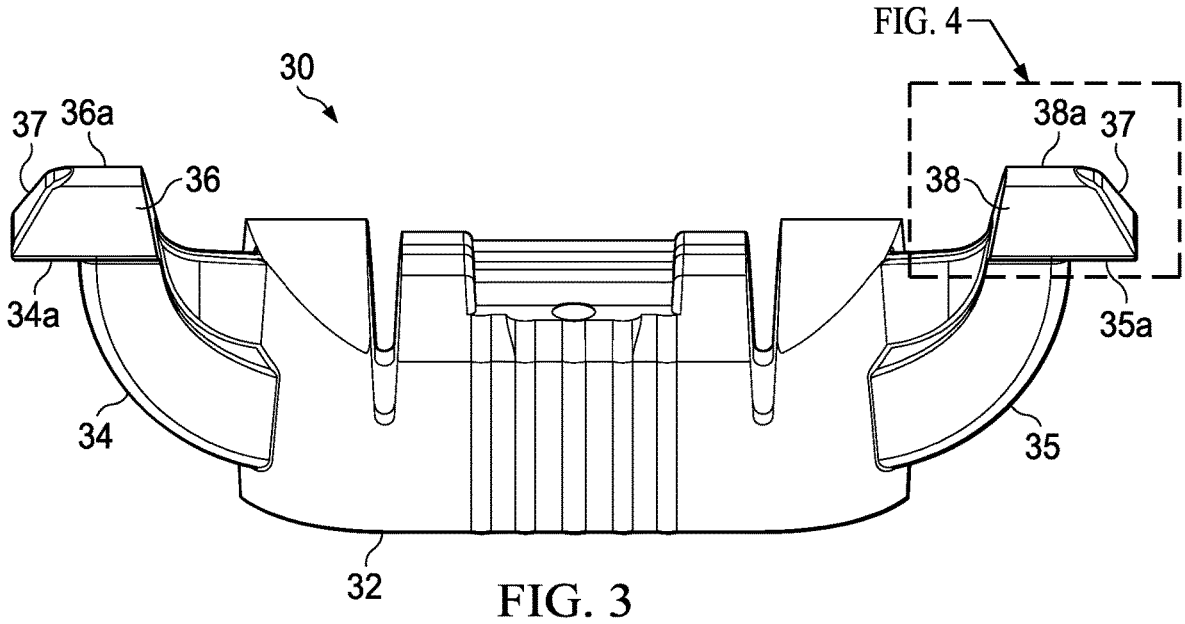
FIG. 3 is a diagrammatical view of a novel connecting member having arms with fingers having two chamfers in accordance with the present invention.

Referring to FIG. 3, a novel connecting member 30 of the present invention is shown having a body 32, a pair of arms 34 and 35 extending outwardly from the body 32. Extending from ends 34*a* and 35*a* of the arms 34 and 35 respectively are fingers 36 and 38.

Figure 4:
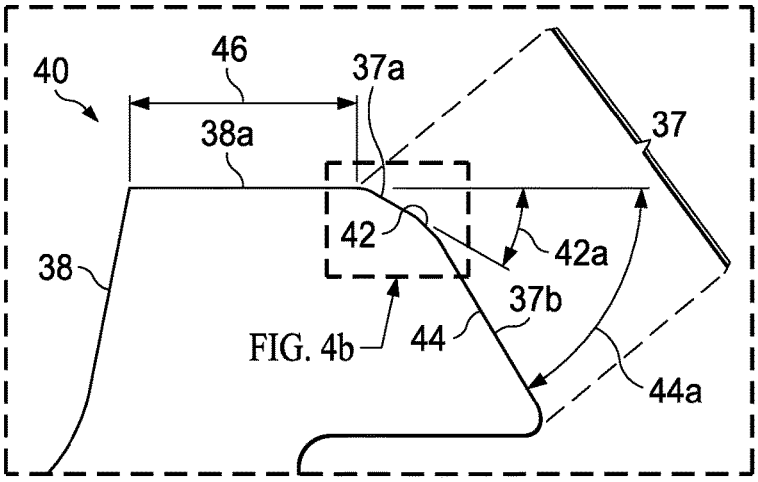
FIG. 4 is a close up view of one finger having two chamfers of the connecting member of FIG. 3.

As can be seen in FIG. 4, a close up view 40 of connecting member 30, finger 38 has an angled profile 37 which includes two chamfers 42 and 44.

First chamfer 42 has an angle 42*a* extending from side surface 37*a* to the top surface 38*a* of the finger ranging from about 15 to about 45 degrees, preferably about 25 degrees, while second chamfer 44 has an angle 44*a* from side surface 37*b* taken to the top surface 38*a* of the finger 38 ranging from about 45 to about 80 degrees, and more preferably about 62 degrees. Top surface 38*a* of finger 38 is desirably a substantially horizontal, straight line, as shown.

Figure 5:
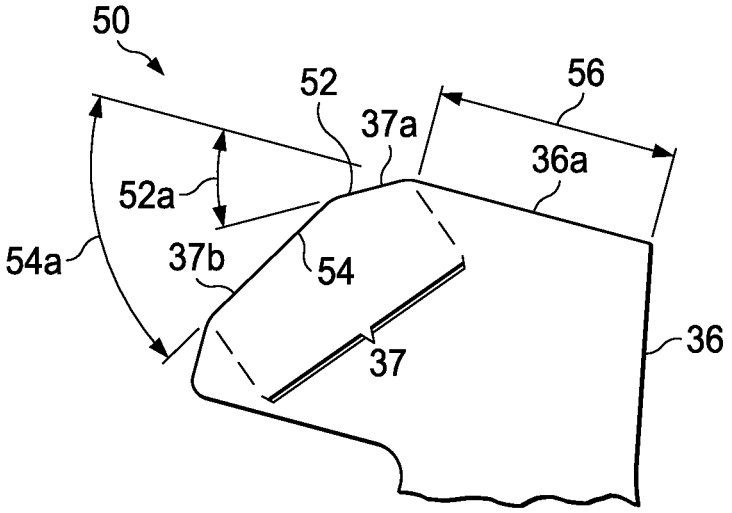
FIG. 5 is a close up view of the other finger having two chamfers of the connecting member of FIG. 3.

Shown in FIG. 5, a close up view 50 of connecting member 30, a matching profile 37 (but flipped horizontally), may also desirably be disposed on finger 36, respectively. In this instance, a first chamfer 52 has an angle 52*a* extending from side surface 37*a* to top surface 36*a* of the finger 36 the ranging from about 15 to about 45 degrees, preferably about 25 degrees, while second chamfer 54 has an angle 54*a* extending from side surface 37*b* to the top surface 36*a* of the finger 36 ranging from about 45 to about 80 degrees, and more preferably about 62 degrees.

The load bearing length 46, 56 of each finger 36, 38 shown in FIGS. 4 and 5 of the present invention ranges from about 1.50 mm to about 2.50 mm, preferably about 1.94 mm. This length in this area is generally important to minimize stress on the housing, to prevent finger breakage, but to also provide adequate surface to surface connection with the housing of a razor cartridge. In the present invention, the angles 42*a*, 52*a* being at about 25 degrees allows the bearing lengths 46, 56 to be as long as possible to provide optimal contact with the housing.

In addition, not only do the bearing lengths 46, 56 and angles 42*a*, 52*a* need to be balanced so as to not compromise contact, together these elements effectively double the clearance to the housing over the prior art as will be described below with FIGS. 4*a* (prior art) and FIG. 4*b* as will be described below.

Figure 4A:
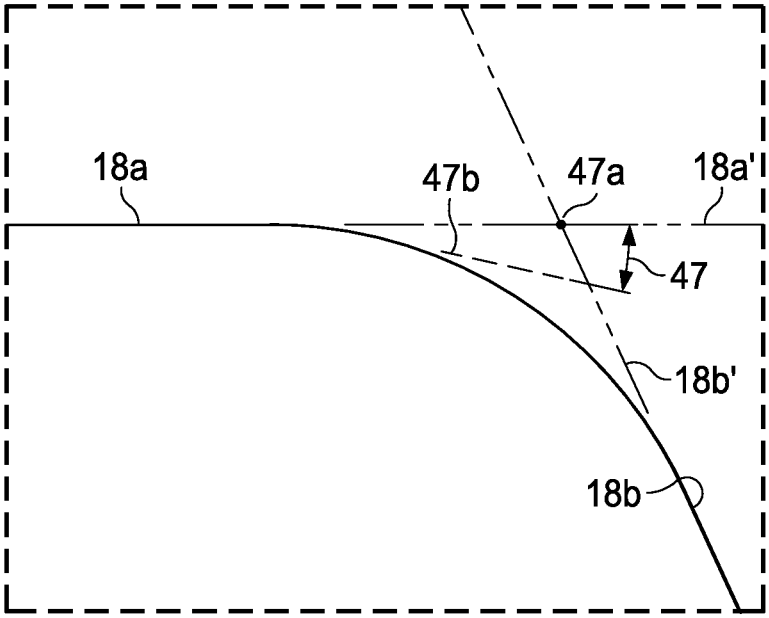
FIG. 4*a* is a close up view of the clearance of the prior art connecting member.

As an example, in FIG. 4*a*, the clearance 47 (e.g., the distance between two objects or the amount of clear space) of the prior art connecting member 10 finger 18 to a razor cartridge housing (not shown) is shown taken at the intersection 47*a* of tangent lines 18*a*' and 18*b*' of surfaces 18*a* and 18*b*, respectively, to a point 47*b* drawn from perpendicular line 47*b*'. The clearance 47 of the prior art connecting member 10 is generally about 0.61 mm.

Figure 4B:
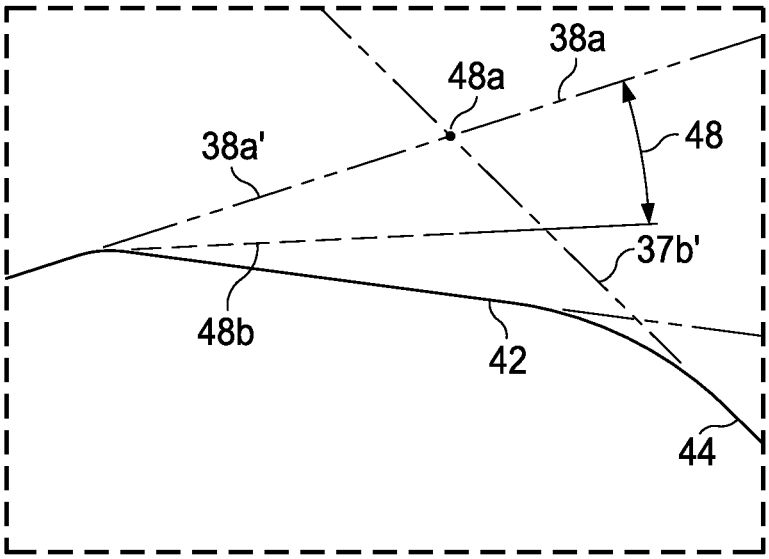
FIG. 4*b* is a close up view of the clearance of the present invention connecting member.

In FIG. 4*b*, the clearance 48 of the present invention connecting member 30 finger 38 to a razor cartridge housing (shown in FIG. 6) is shown taken at the intersection 48*a* of tangent lines 38*a*' and 38*b*' of surfaces 38*a* and 38*b*, respectively, to a point 48*b* drawn from perpendicular line 48*b*'. The clearance 48 of the double chamfer embodiment of the present invention is generally about 0.134 mm, and thus, almost double the clearance of the prior art.

Figure 6:
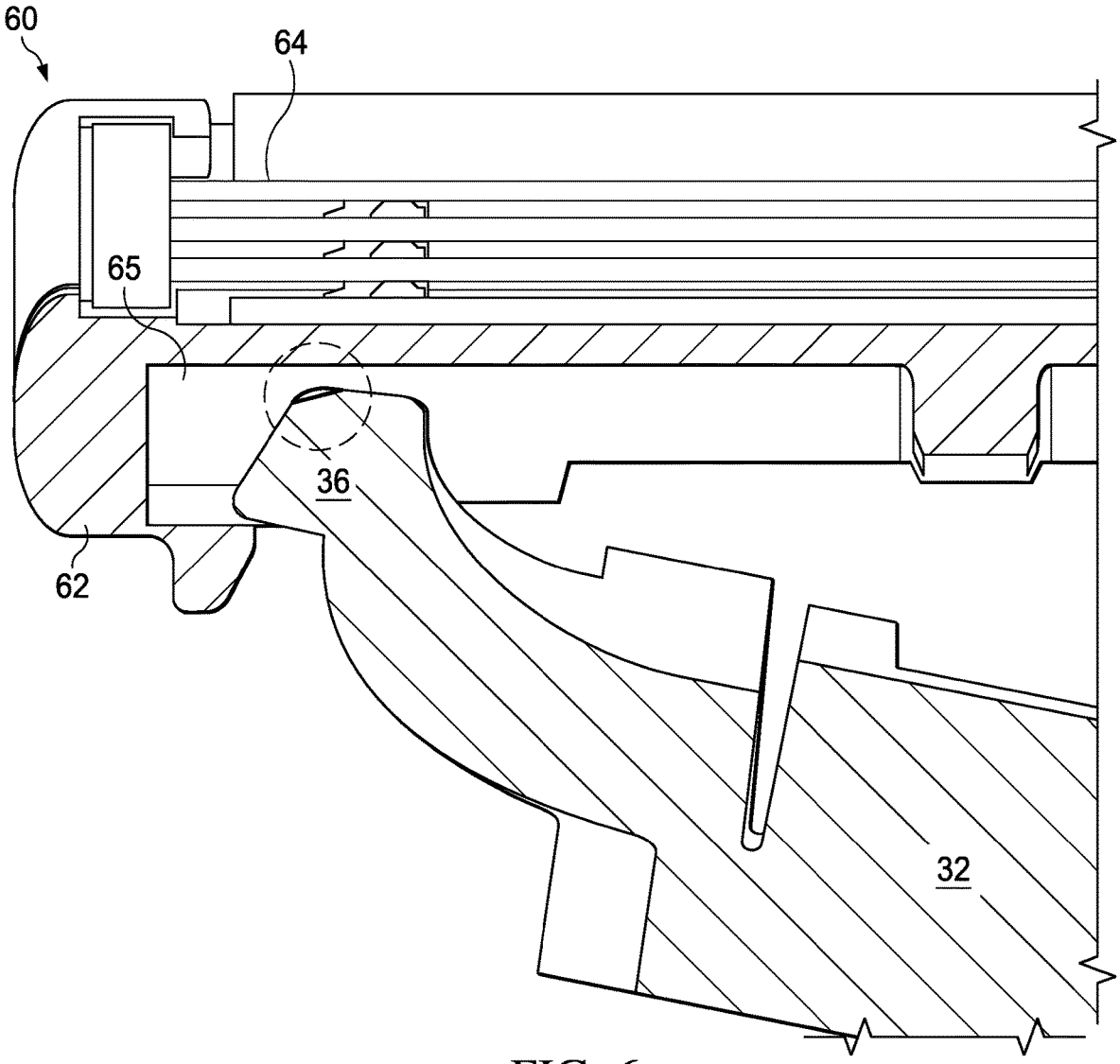
FIG. 6 is a diagrammatical view the connecting member of FIG. 3 as it would be attached to a razor cartridge having a blade unit in accordance with the present invention.

Having a larger clearance 48 desirably eases attachment of the connecting member to the razor housing over the prior art. In FIG. 6, the connecting member 30 of the present invention of FIG. 3 is shown just prior to being attached or coupled to a razor housing 62 of a razor cartridge 60 having a plurality of blades 64. Housing 62, in accordance with the present invention, has finger receiving areas or openings 65 (one shown in FIG. 6) which retain the fingers 36 and 38. The fingers 36 and 38 desirably pivotally connect to the razor cartridge 60, e.g., by insertion into openings 65 in the back of the housing 20 (FIG. 6) and allow the razor cartridge 60 to desirably pivot relative to the connecting member 30. Thus, the double chamfer embodiment of the present invention, by providing a maximum bearing length and improved clearance, enhancing pivot dynamics and connecting member to housing retention.

Figure 7:
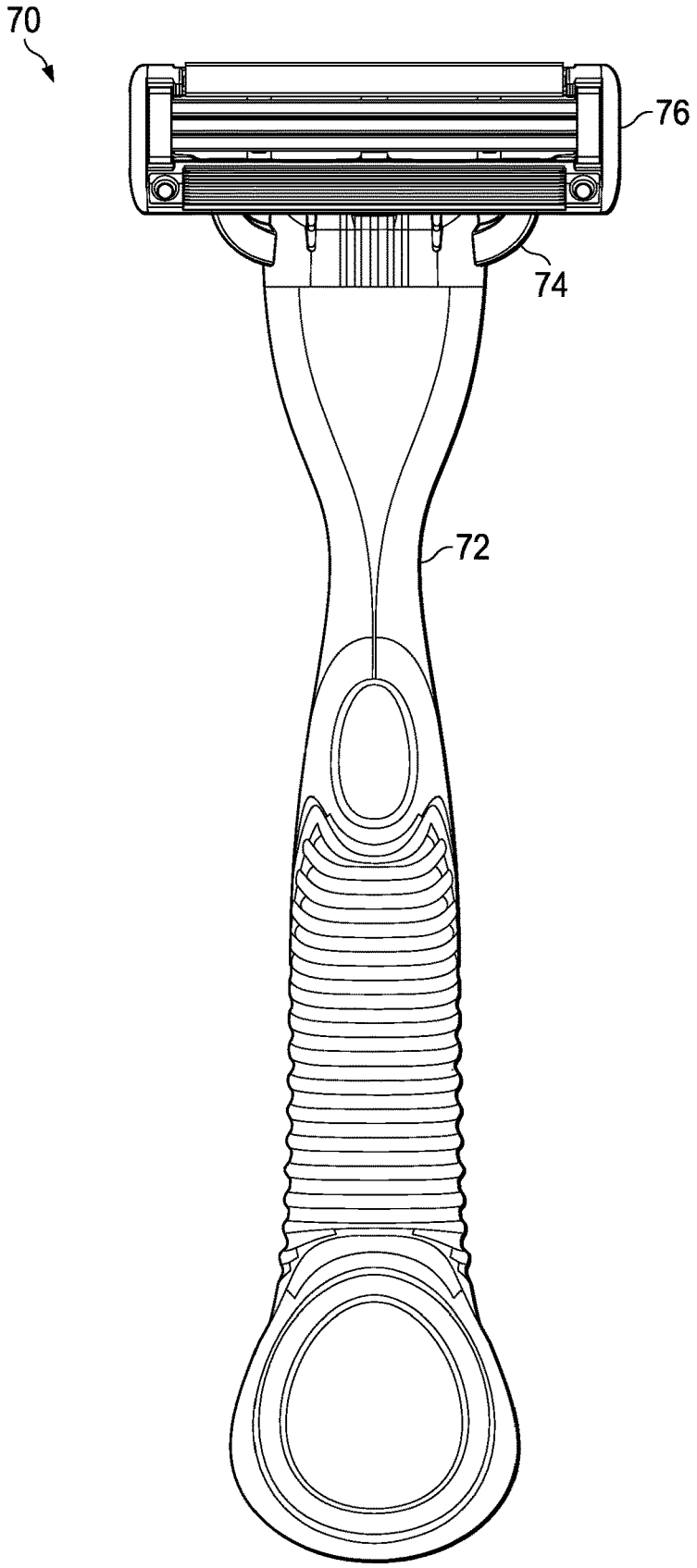
FIG. 7 is a diagrammatical view of a razor having an integrated connecting member on an upper portion of a handle in accordance with the present invention.

FIG. 7 depicts a razor 70 having a razor handle 72 with an integrated connecting member 74 on an upper portion of the handle. The connecting member 74 is attached to razor cartridge 76 as described herein and thus, with novel fingers and angles, the chamfer arrangement provides improved pivot mechanism, control, and clearance.

An alternate embodiment of the present invention may include having three or more chamfers (not shown).

Additionally, it is contemplated in the present invention that only one side of the connecting member (e.g., only finger 38 or only finger 36) include the novel chamfer feature. The other finger may be of any other type found in the prior art or may be a double chamfer but of different dimensions, or a triple chamfer of the present invention. Not having identical or not having substantially symmetrical features at the distal ends of the fingers, however, may present issues such as operational problems during a shave, and likely may not assist in assembly.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor comprising:

a cartridge having a housing;

a razor handle having an axis along its length, a razor connection member comprising:

at least one finger having a bearing length having a first chamfer oblique to said axis and facing away from the razor handle, and a second chamfer oblique to said axis and facing away from said handle, wherein said second chamfer is arranged oblique to and contiguous to said first chamfer, wherein said first chamfer is configured to be at an angle to avoid obstruction with the cartridge housing during insertion.

2. The razor of claim 1 wherein said connecting member is separable from said razor handle.

3. The razor of claim 1 wherein said connecting member is integrated with said razor handle.

4. The razor of claim 1 wherein a first chamfer angle of said first chamfer of said plurality of chamfers is smaller than a second chamfer angle of said second chamfer of said plurality of chamfers.

5. The razor of claim 1 wherein said first chamfer has an angle ranging from about 15 to about 45 degrees.

6. The razor of claim 1 wherein said second chamfer has an angle ranging from about 45 to about 80 degrees.

7. The razor of claim 1 wherein said bearing length of said at least one finger ranges from about 1.50 mm to about 2.50 mm.

8. The razor of claim 1 wherein said first chamfer has an angle of about 25 degrees and said at least one finger has a bearing length of about 1.94 mm.

9. The razor of claim 1 wherein a clearance of said finger to said cartridge housing is about 0.134 mm.

10. The razor of claim 1 wherein said at least one finger attaches to said cartridge housing.

11. The razor of claim 10 wherein said cartridge housing comprises an attachment, and said attachment comprises an opening at a back of said cartridge housing into which one of said at least one finger is disposed.

12. The razor of claim 1 wherein one of said at least one finger extends from an arm.

* * * * *